United States Patent [19]

Kelley

[11] Patent Number: 4,840,590

[45] Date of Patent: Jun. 20, 1989

[54] SURFBOARD TRACTION BAR

[76] Inventor: Thomas J. Kelley, 919 Calle Amanecer St., Suite N, San Clemente, Calif. 92672

[21] Appl. No.: 83,115

[22] Filed: Aug. 6, 1987

[51] Int. Cl.[4] ..... B63B 35/72

[52] U.S. Cl. ..... 441/74

[58] Field of Search ..... 4/581–583; 114/242, 253, 39.2; 441/65, 68, 74, 70; 106/36; 52/179

[56] References Cited

U.S. PATENT DOCUMENTS

| | | | |
|---|---|---|---|
| 2,822,553 | 2/1958 | Florentine | 4/583 |
| 3,308,493 | 3/1967 | Lambach | 441/74 |
| 3,593,356 | 7/1971 | Schmalfeldt | 441/74 |
| 3,921,239 | 11/1975 | Sovia et al. | 441/65 |
| 4,321,048 | 3/1982 | Marchese et al. | 441/74 |
| 4,592,734 | 6/1986 | Metiver | 441/74 |
| 4,625,344 | 12/1986 | Howard | 4/582 |

FOREIGN PATENT DOCUMENTS 424099 2/1935 United Kingdom .

OTHER PUBLICATIONS

P. 22 of Sears Boating and Fishing Catalog, 1974.

*Primary Examiner*—Joseph F. Peters Jr.
*Assistant Examiner*—Edwin L. Swinehart
*Attorney, Agent, or Firm*—David N. Makous

[57] ABSTRACT

A surfboard traction device using an elongated bar and adhesive for mounting the bar on the deck of the surfboard.

8 Claims, 1 Drawing Sheet

SURFBOARD TRACTION BAR

BACKGROUND OF THE INVENTION

1. Field of the Invention

The present invention applies generally to traction devices applied to the surface of water sports boards, particularly to surfboards.

2. Background

The sport of surfboarding is comprised of riding the surf in a body of water where the rider is atop a board designed for such use called a surfboard. The surfboard is a long, narrow, buoyant board, usually comprised of a lightweight wood or fiberglass covered foam which is used to elevate the user by carrying him along the crest of a wave.

In order to assist the user in keeping his balance and control of the surfboard, it has been useful to apply a wax coating to the deck portion of the surfboards such that the user's traction on the decks is improved. Since wax is not water soluble, it resists the slippery effect of water on the deck, and thus increases the traction between the user's feet and the deck.

Over the years the designs of surfboards have evolved and surfboards have become reduced in length and weight thus being smaller and lighter. Because of this it has become necessary to provide for better systems of traction to assist the user in maintaining his balance, control, and contact with the deck of the board.

One design of a traction device previously known in the art was that of a pad in a crescent or banana shape and comprised of neoprene having an adhesive coating on its base surface with a removable protective wax paper covering. This pad was to be mounted near the tail section of the board such that the concave portion of the crescent was suitably positioned to abut the heel of the user's feet, and the convex portion positioned closest to the tail section. However, the full traction needs of the user were not suitably provided for by this crescent pad, as it was designed to be used near the heel of the foot of the user, and only between 3" to 4" long in its arc measurement. A traction device has been needed which has a wider range of usefulness, which provides for greater board control while shifting the feet along a range of areas in both the front and back areas of the surfboard. The surfboard traction device and method of the present invention has improved the traction and thus the balance and control of the user.

SUMMARY OF THE INVENTION

The invention provides a surfboard traction device comprised of an elongated bar with a means for mounting the bar on the deck of the surfboard. The elongated bar is preferably utilized in a pair: one nearer the front of the board and one nearer the back of the board. The bar is also tapered on its ends, and contoured for positioning along the stringer, preferably just adjacent and parallel to it, and can be a substantially rectangular solid with a flat upper surface, flat opposing elevating surfaces, and a flat base surface. The upper surface and the elevating surfaces, can be in many configurations, for example, arced or rounded in shape.

The base surface should be contoured to fit the shape of the deck, or be flexible enough to be shaped to the deck's surface when mounted to form a substantially contiguous fit. The base surface is coated with a layer of an adhesive, preferably moisture resistant, and covered with a removable protective paper. To apply the device to the deck of the board the protective paper is removed, thus exposing the adhesive layer for contact with the deck of the board. By the application of pressure the adhesive causes the mounting of the device to the deck of the board.

The bar can be a plastic material, preferably of ethyl vinyl acetate (EVA), and the adhesive can be a tackifying bonding agent, preferably of a resin type.

The present invention also provides for a T-shaped bar, having a means for mounting on the deck of a board. The T-shaped bar is preferably a unitary piece having both a crossing portion and a longitudinal portion which are suitably mounted near the tail section of the board with the crossing portion parallel to the edge of the tail of the board, and with the longitudinal portion along the stringer. The crossing portion acts primarily as a footbrace in coordination with the longitudinal portion which primarily provides the means for board control by the user, acting in much the same way as the single elongated bar.

The present invention also provides for a surfboard traction method, using a surfboard traction device, which generally provides for the preparation of the deck of the board for mounting removal of the protective paper thus exposing the adhesive layers coated on the base surface of the device, the desirable positioning of the device on the deck, contacting the adhesive layer with the deck, followed by the application of adequate pressure to the device to effect its adhesion to the deck.

Other features and advantages of the invention will become apparent from the following detailed description taken in conjunction with the accompanying drawings, which illustrate, by way of example, the features of the invention.

DETAILED DESCRIPTION OF THE PREFERRED EMBODIMENT

The invention is embodied in many forms, some of which are illustrated by the drawings.

Figure 4:
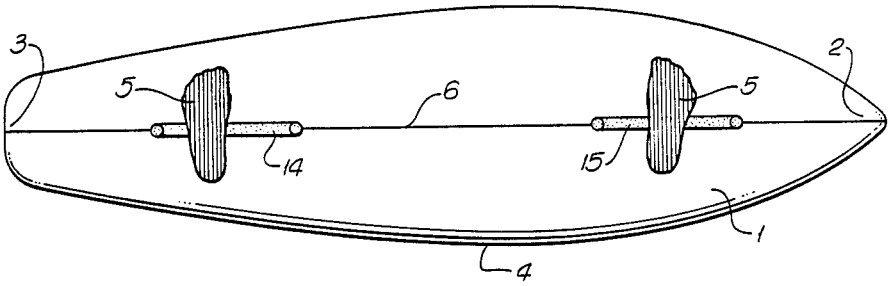
FIG. 4 is a plan view of a surfboard having a pair of elongated bars mounted on the deck with a schematic of the user's footprints.

A surfboard is generally comprised of a number of sections. Referring to FIG. 4 can be seen the primary sections of a surfboard. Illustrated there are the deck 1, the nose section 2, the tail section 3, the rail section 4 along the periphery of the board, the user's feet 5, and the stringer 6. Generally a surfboard itself is comprised of a fiberglass covered foam or a wood material. When it is fiberglass it is united in the center of the board along the stringer 6 which is the location of the longitudinal joining of the two sides of the fiberglass.

As assisting in the illustration of the preferred embodiment of the invention, initial reference is made to FIGS. 1 through 4 wherein can be seen representations of the preferred embodiment.

In the preferred embodiment the surfboard traction device is comprised of an elongated bar 7 which is a solid having tapered ends 8 and 9. The bar has an upper surface 10, a base 11, and two opposing elevating surfaces 12 and 13.

A bar is defined as a straight piece of material that is longer than it is wide which upon mounting is fixed in place. The exposed portions of the bar after mounting may be elastic, and should be suitably comfortable for contact with the user's foot.

The elongated bar can be mounted anywhere along the board, but is suitable for its placement along the stringer 6, and are well utilized as a pair. One bar 14 is placed near the tail section 3 of the surfboard and the other bar 15 is placed near the nose section 4 of the surfboard along the stringer 6. This placement however is not so restricted and is as desired by the user. The bars are preferably of sufficient length A, width B and heighth C to facilitate increased leverage, balance and control by the user's foot or feet by improving the contact of the foot with the bar and deck of the board, thus improving control and reducing the risk of the user falling off the deck of the board while riding.

The placement of a bar longitudinally along the stringer 6 facilitates the movement of the user's foot through a wide range of longitudinal positioning as the user moves up and down along the length of the board. The contact of the foot with the bar increases the turning leverage of the user, allowing the user to tilt and sway and otherwise move the board up and down and from side-to-side while maintaining contact of the foot with the board.

The tapered ends 8, 9 are preferred, but not required. A tapered end of the bar provides easier sliding of the user's foot back onto the bar when the user's foot reaches beyond either end.

Figure 1:
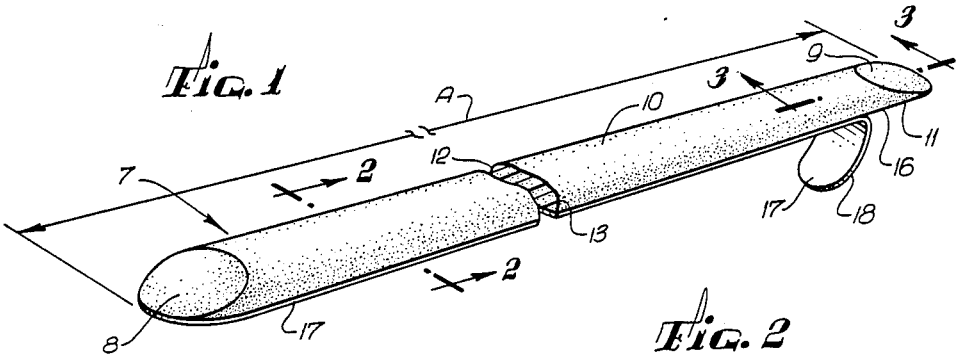
FIG. 1 is a perspective view of a single elongated bar.
Figure 2:
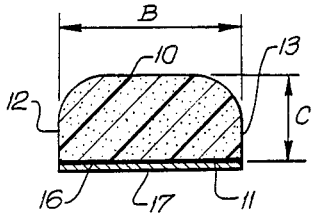
FIG. 2 is a cross-section of the bar of FIG. 1 along lines 2—2.
Figure 3:
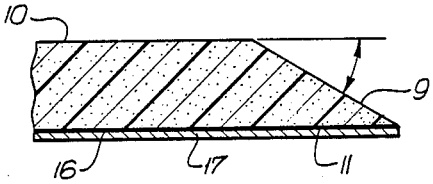
FIG. 3 is a fragmentary longitudinal section of the bar of FIG. 1 along lines 3—3.
Figure 5:
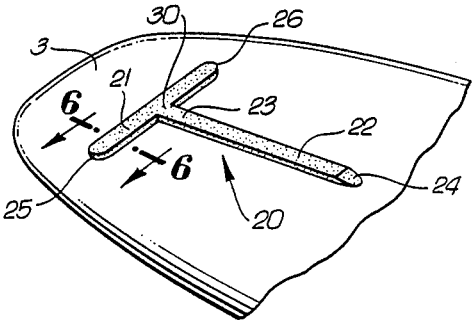
FIG. 5 is a perspective view of a T-bar mounted on a deck with a fragmentary view of the deck.
Figure 6:
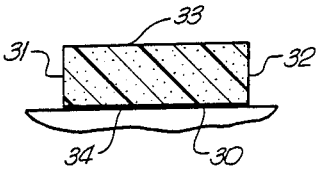
FIG. 6 is a cross-section of the T-bar of FIG.5 along the lines 6—6.

The upper surface and the elevating surfaces of the bar can be many shapes, such as rounded (as seen in FIGS. 1 and 2) or flat (as seen in FIGS. 5 and 6). For some users rounded surfaces may be more comfortable and allow easier movement of the foot onto the surfaces of the bar.

The upper and elevating surfaces can be of rounded contour or shape as, for example, is displayed in FIGS. 1 and 2. The rounded contour can fit more naturally within the underside of the user's foot at the arch or mid-portion of the foot where it has a generally rounded contour also. This is particularly so when the underside of the foot and the bar are mated in the general relationship as illustrated in FIG. 4.

A bar having a rounded upper and elevating surface contour provides for contact of the user's foot mutually with both the deck and the bar. For example, when the bar's dimensions are those of the preferred embodiment i.e. width dimension B of $\frac{3}{4}''$ and thickness dimension C of $\frac{1}{2}''$, both the front portion and rear portion of the user's foot can be in contact with the deck while the midportion is in contact with the bar. For some users flat surfaces, which provides a sharp right-angle relationship of the upper surface and the elevating surface can provide for a firmer toe bite or foot bite onto the bar itself.

These design features are not limitations on the invention, but rather are examples of some surface shapes according to the invention.

In the preferred embodiment the elongated bars are about twelve inches long at its maximum length, about three-quarters of an inch wide at its maximum width, and about one-half inch thick at its maximum thickness.

In the preferred embodiment the bar material is comprised of an ethylene-vinyl acetate (EVA) which are known, and which are generally plastic copolymers from a family of thermoplastic polymers ranging from five to fifty percent by weight of vinyl acetate incorporated into an ethylene chain.

Many materials, including many plastic and rubber materials are suitable for the bar material, and this invention is not limited to these examples.

The base surface 11 is preferably flat or otherwise shaped, or of a flexible property to be shaped, to provide a substantially contiguous fit with the deck of the board.

The base surface is preferably coated with an adhesive layer 16. This adhesive accomplishes the mounting of the device on the deck of the board upon contact. The adhesive can be applied prior to mounting and need not be an inherent part of the base surface. In the preferred embodiment the adhesive is pre-coated to the base surface to form a layer along its entire surface, and part of the manufactured device. This adhesive is comprised preferably of a resin-type adhesive made substantially from urea formaldehyde. It is further preferred that it be a moisture-resistant bonding agent with tackifying characteristics. Many synthetic bonding agents and adhesives are suitable for the application of this adhesive and are known in the art.

In the preferred embodiment the adhesive is precoated to the base surface of the bar, and sufficient coating is made to provide a discrete layer of adhesive on the base surface of the bar.

Because the pre-applied adhesive has tackifying characteristics which result in its adhesion to the deck upon contact, it is preferable that the layer of coating be protected, prior to use, from adhesion to an undesired surface by some protective means. In the preferred embodiment the protective means is comprised of a paper 17 with its surface 18 in contact with the coating layer and being waxed so as to provide ease of removal of the paper, such as by a peeling off action. Upon removal of the protective paper the adhesive is fully exposed and ready for adhesion to the desired surface.

In order to mount the bar on the deck of the board in adequate fashion so that the bar does not dislocate from the deck upon use, the surface of the deck must be suitably prepared. Thus it is usually necessary to remove any interfering fluids and substances, such as sand, oil and wax, which are on the portion of the deck where the bar is to be mounted. Removal can be accomplished by a number of ways known in the art, such as by cleaning, scraping with a suitable scraping tool, or by applying a suitable solvent such as acetone. Sawdust and flour can also be utilized to remove some residues.

To get the preferred stable mounting of the device, it is also desirable to apply acetone or isopropyl alcohol to the surface to further cleanse the area where the mounting is to occur.

Upon this preparation the traction device is ready for application to the board. The protective paper is then removed, and the base surface of the bar is positioned relative to the location on the board where the mounting is to occur. Then if necessary the base surface adhesive is applied, or the protective means is removed exposing the adhesive layer for contact with the deck of the board. Pressure is then applied in sufficient amount to secure the bonding of the adhesive to the board. In order to adequately assure the completeness of the bonding, it is recommended that before use a sufficient waiting period be undertaken after pressing the adhesive to the deck. In many cases a one hour waiting period of time is sufficient.

The board with the mounted traction device is then ready for use.

Another embodiment of the invention is comprised of a T-shaped bar having a means for mounting on the surface of the board. It is preferably mounted near the tail section of the board. Reference to FIGS. 5 and 6, show the preferred embodiment of the T-shaped bar 20. It is comprised of a crossing portion 21 and a longitudinal portion 22. The crossing portion 21 is normal to one end 23 of the longitudinal portion 22 and symmetric about the longitudinal portion at the junction 30. The distal end 24 of the longitudinal portion is preferably tapered. The crossing portion 21 is a substantially rectangular solid having rounded ends 25,26 which substantially are rounded like the section of a cylindrical surface. The longitudinal portion 22 is also preferably a substantially rectangular solid with a tapered end 24.

Like the elongated bar, the T-shaped bar provides for improved control, balance and leverage also. The crossing portion can act as a foot brake keeping the user's foot from moving closer to the tail section 3 and off the edge of the board. The longitudinal portion can act much the same way as the elongated bar previously discussed above, such that it too provides increased leverage, improved control for turning, and allows the user's foot to move throughout a wide range of movement longitudinally along the deck.

The base surface 30, elevating surfaces 31, 32, and upper surface 33 are preferably as illustrated in the FIGS. 5 and 6. However they have the same range of designs as the elongated bars previously described, that is, including but not limited to, arced, rounded or flat. The base surface is preferably coated with an adhesive layer 34 and protective means (not shown) like the elongated bar as previously described.

In the use of the board the user may apply substantial pressure to the various exposed surfaces of the bars as mounted. One advantage of the T-shaped bar is that it reduces the likelihood of dislocation of the bar from the deck after mounting and during use. For example, upon substantial pressure applied to the crossing portion 21, the longitudinal portion 22 can act to increase inertia of the whole bar reducing the risk that the entire bar will be dislocated from the board. Likewise, upon substantial pressure applied to the longitudinal portion 22, the crossing portion can act to increase inertia, and reduce the risk of dislocation of the entire bar from the deck of the board.

The dimensions of the preferred embodiment of the T-bar are as follows: the crossing section's length is about four inches; the longitudinal section's length is about twelve inches; the width of each of these sections is about one inch; and the thickness of each is about one-half an inch.

The invention also comprises a surfboard traction method using the surfboard traction device. In the preferred embodiment the method is comprised of selecting a surfboard traction device according to the invention which is comprised of a bar having a means for mounting the bar to the deck of the board wherein the bar is comprised of a base surface coated with an adhesive layer covered by removable protective wax paper. The deck of the board is suitably prepared for mounting the traction device by cleaning and other methods described above. The protective paper is removed exposing the adhesive layer on the base surface and the bar is then positioned on the deck of the board in a suitable location, contacting the adhesive with the deck, and then applying sufficient pressure to the device to effect the adhesion of the device to the board. This method can be utilized with all embodiments of the invention.

A combination of the various embodiments of the invention, some of which are described above can also be utilized to effect surfboard traction. For example, a T-bar might be mounted near the tail section of the board and then an elongated bar affixed parallel to the longitudinal section of the T bar, also near the tail section.

Also a multiple of elongated bars may be used by mounting them in different places along the deck of the board.

These embodiments are not limited to the specific embodiments described above and other forms of the invention are within its spirit and scope as set forth in the claims hereafter.

What is claimed is:

1. A surfboard traction bar formed of an elastomeric material, for mounting on the deck of a surfboard to comfortably engage the arch of the user's foot, said bar having an upper surface, opposing elevating surfaces, and a base surface, said base surface having means for mounting the bar on a deck, said upper and opposing surfaces having sufficient width and thickness, respectively, such that, when mounted and used, the bar engages the arch of the user's foot and allows both the front and rear portions of the foot to remain in contact with the deck on opposite sides of the bar.

2. The surfboard traction bar as recited in claim 1 wherein said bar further includes tapered ends.

3. A bar as in claim 1 having a length several times longer than the width of said bar.

4. The surfboard traction bar as recited in claim 1 further including a surfboard wherein said bar is mounted on the deck of said surfboard.

5. The surfboard traction bar as recited in claim 1 further including a surfboard wherein said bar is mounted longitudinally on a deck of said surfboard.

6. A surfboard traction bar formed of elastomeric material for mounting on the deck of a surfboard, said bar having an upper surface and two opposing elevating surfaces, a base surface including means for mounting said bar, said upper and opposing surfaces having sufficient width and thickness, respectively, such that, when mounted and used, the bar engages the arch of the user's foot and allows both the front and rear portions of the foot to remain in contact with a deck on opposite sides of the bar without employing a securing strap in communication with said bar.

7. The surfboard traction bar as recited in claim 6 further including a surfboard wherein said bar is mounted on the deck of said surfboard.

8. A surfboard traction bar formed of an elastomeric material for mounting on the deck of a surfboard for comfortably engaging the arch of a user's foot, said bar having an upper surface, opposing elevating surfaces, and a base surface, said base surface having means for mounting said bar on a deck, wherein said upper surface and said elevating surfaces are suitably shaped for allowning the underside of a user's foot to contact both said deck and said bar, with said bar having a length of approximately twelve inches, a width of approximately three-quarters of an inch, and a thickness of approximately one-half of an inch.

* * * * *